United States Patent [19]

Grimes et al.

[11] Patent Number: 4,651,804

[45] Date of Patent: Mar. 24, 1987

[54] CASTING LIGHT METALS

[75] Inventors: Roger Grimes; Derek C. Martin, both of Gerrards Cross, England

[73] Assignee: Alcan International Limited, Montreal, Canada

[21] Appl. No.: 688,562

[22] Filed: Jan. 3, 1985

[30] Foreign Application Priority Data

Jan. 9, 1984 [GB] United Kingdom ..... 8400426

[51] Int. Cl.[4] ..... B22D 11/22; B22D 11/124

[52] U.S. Cl. ..... 164/455; 164/414; 164/444; 164/487

[58] Field of Search ..... 164/451, 452, 5, 150, 164/154, 414, 443, 444, 455, 485, 486, 487, 418, 459

[56] References Cited

U.S. PATENT DOCUMENTS 4,509,582 4/1985 Kriegner ..... 164/444

FOREIGN PATENT DOCUMENTS 868373 12/1941 France ..... 164/444

57-202951 12/1982 Japan ..... 164/5

OTHER PUBLICATIONS

"Explosions of Molten Aluminum in Water—Cause and Prevention", by George Long, *Metal Progress,* pp. 107–112, May 1957.

"Melt-Coolant Interactions", A Report, Alexander, Chamberlain & Page, Research Agreement 7205-16/801/08, The University of Aston in Birmingham, Section 5, A Generalisation of Long's Criteria, pp. 61–77.

*Primary Examiner*—Nicholas P. Godici

*Assistant Examiner*—Richard K. Seidel

*Attorney, Agent, or Firm*—Browdy and Neimark

[57] ABSTRACT

A method of and an apparatus for vertical, semi-continuous direct chill casting of light metal fabricating ingots of particularly, though not exclusively, lithium containing aluminium and magnesium alloys, through an open mould into a pit, comprising commencing the casting without a pool of water within the pit, supplying cooling water to the emergent ingot at a predetermined rate and continuously removing water from the pit as casting continues at a rate sufficient to ensure that no build up of a pool of water in the pit occurs, whereby the risk of violent and damaging explosion is further reduced.

11 Claims, 1 Drawing Figure

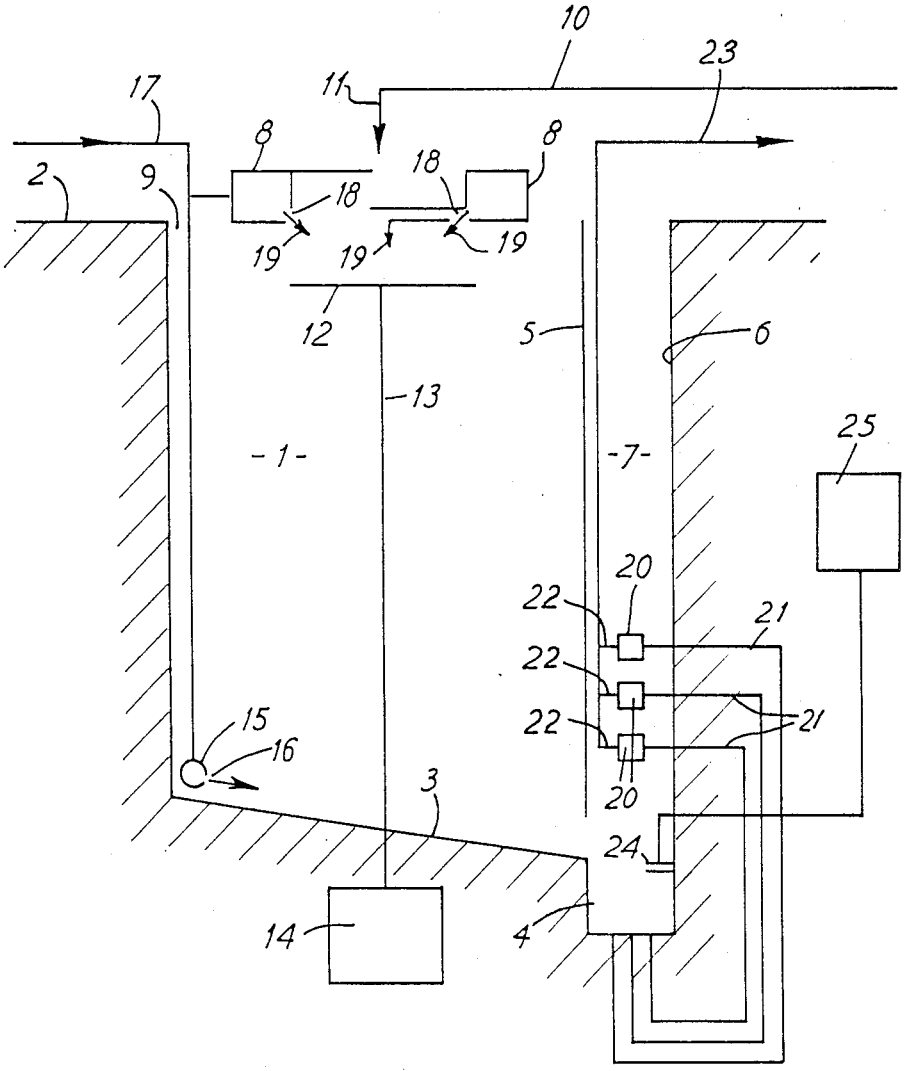
10
23
17
11
8
8
2
9
18
18
19
19
19
12
5
6
13
25
- 1 -
-7-
20
22
21
22
22
21
15
16
20
3
24
14
4

CASTING LIGHT METALS

BACKGROUND OF THE INVENTION

This invention relates to the casting of light metals such as aluminium or magnesium and their alloys.

Light metals such as aluminium or magnesium and their alloys are usually cast in the form of fabrication ingots which are then further worked, for example by rolling or extrusion. Such ingots are usually produced by the vertical, semi-continuous, direct chill (DC) method. This method was developed between forty and fifty years ago and produces higher quality and cheaper castings than had previously been possible using permanent moulds.

It is likely that in the earlier years of DC casting the operation was performed above ground level although it has not been established that it was; this would have presented two disadvantages, firstly there was a practical limit to the length of fabrication ingots that could be produced and secondly, if a "run-out" from the mould occurred, large quantities of molten metal falling from a considerable height could be distributed over a wide area with consequent danger to personnel and damage to plant.

DESCRIPTION OF THE PRIOR ART

It has become standard practice to mount the metal melting furnace slightly above ground level with the casting mould at, or near to, ground level and the cast ingot is lowered into a water containing pit as the casting operation proceeds. Cooling water from the direct chill flows into the pit and is continuously removed therefrom while leaving a permanent deep pool of water within the pit. This process remains in current use and, throughout the world, probably in excess of 5 million tons of aluminium and its alloys are produced annually by this method.

There have been many explosions throughout the world when "run outs" have occurred in which molten metal escaped from the sides of the ingot emerging from the mould and/or from the confines of the mould, using this process. In consequence considerable experimental work has been carried out to establish the safest possible conditions for DC casting. Among the earliest and perhaps the best known work was undertaken by G. Long of the Aluminum Company of America ("Metal Progress" May 1957 pages 107 to 112); this has been followed by many further investigations and the establishment of industry "codes of practice" designed to minimise the risk of explosion. These codes are generally followed by foundries throughout the world; they are broadly based upon Long's work and usually require that:

(1) the depth of water permanently maintained in the pit should be at least 3 feet, (2) the level of water within the pit should be at least 10 feet below the mould, (3) all the casting machine and pit surfaces should be clean, rust free and coated with proven organic material.

In his experiments Long found that with a pool of water in the pit having a depth of 2 inches or less, very violent explosions did not occur. However, instead, lesser explosions took place sufficient to discharge molten metal from the pit and distribute this molten metal in a hazardous manner externally of the pit. Accordingly the codes of practice, as stated above, require that a pool of water having a depth of at least 3 feet is permanently maintained in the pit.

Long had drawn the conclusion that certain requirements must be met if an aluminium/water explosion is to occur. Among these was that a triggering action of some kind must take place on the bottom surface of the pit when it is covered by molten metal and he suggested that this trigger is a minor explosion due to the sudden conversion to steam of a very thin layer of water trapped below the incoming metal. When grease, oil or paint is on the pit bottom an explosion is prevented because the thin layer of water necessary for a triggering explosion is not trapped beneath the molten metal in the same manner as with an uncoated surface.

In practice, the recommended depth of at least 3 feet of water is always employed for vertical DC casting and in some foundries (notably in continental European countries) the water level is brought very close to the underside of the mould in contrast to recommendation (2) above. Thus the aluminium industry, casting by the DC method, has opted for the safety of a deep pool of water permanently maintained in the pit. It must be emphasised that the codes of practice are based upon empirical results; what actually happens in various kinds of molten metal/water explosions is imperfectly understood. However, attention to the codes of practice has ensured the virtual certainty of avoiding accidents in the event of "run outs" with aluminium alloys and probably also with magnesium and copper alloys.

Another extensive study of melt-coolant interactions was made at the University of Aston between 1978 and 1981 by Alexander, Chamberlain and Page and resulted in a report dated April 1982. This further study was made with the support of the European Coal and Steel Community and part of the report (pages 61 to 67) refers to a generalisation of Long's safety criteria and states:

> "Long's criteria have been used widely to define safe conditions of operation. They are to be construed, not as conditions which will prevent MCI (melt-coolant interactions), but rather as conditions which will prevent a particular type of trigger. As such, they are valid and, suitably interpreted, apply to all materials. Their use will materially improve safety at work, since the type of trigger which they prevent is by far the most common."

The report ends with five recommendations. The first three of these are restatements of Long's original criteria (and are referred to as such) and the other two relate to additional precautions which are felt to be desirable.

In the last decade there has been growing interest in light metal alloys containing lithium. Lithium makes the molten alloys more reactive. In the above mentioned article in "Metal Progress", Long refers to previous work by H. M. Higgins who had reported on aluminium/water reactions for a number of alloys including Al/Li and concluded that "When the molten metals were dispersed in water in any way . . . Al/Li alloy . . . underwent a violent reaction." It has also been announced recently by the Aluminum Association Inc. (of America) that there are particular hazards when casting such alloys by the DC process. The Aluminum Company of America has subsequently published video recordings of tests that demonstrate that such alloys can explode with great violence when mixed with water.

OBJECT OF THE INVENTION

It is an object of the present invention to provide an improved method of and apparatus for the vertical semi-continuous direct chill casting of light metals and particularly, though not exclusively, lithium containing aluminium and magnesium alloys whereby the risk of violent and damaging explosion is further reduced.

SUMMARY OF THE INVENTION

According to one aspect of the present invention there is provided a method of vertical, semi-continuous direct chill casting of light metal fabrication ingots through an open mould into a pit, comprising commencing the casting without a pool of water within the pit, supplying cooling water to the emergent ingot at a predetermined rate and continuously removing water from the pit as casting continues at a rate sufficient to ensure that no build up of a pool of water in the pit occurs.

According to another aspect of the invention there is provided apparatus for the vertical semi-continuous direct chill casting of light metal fabrication ingots through an open mould disposed above a pit for receiving the resultant ingot including means for supplying cooling water to the mould, to the surface of the emergent ingot and into the pit, comprising means, communicating with every part of the pit at which a pool of water could build up, capable of continuously removing water from all of such parts at a total rate greater than the maximum rate of supply of water to all such parts of the pit.

In this specification, when we refer to a "pool" of water in the pit we mean a deliberately maintained quantity of water covering the whole of the base of the pit and which would remain as a permanent pool of static height if the supply of water to the pit ceased.

In addition it is to be understood that where reference is made to a "pit" this can be a casting enclosure that is partially or wholly above ground level.

All the published studies leading to the establishment of the codes of practice referred to above repeatedly assert that if the process of direct chill casting did not involve contact of molten metal with any water no explosion problem could arise. By the nature of the process this is not possible (other cooling liquids could be employed but with substantially the same or greater disadvantages as water and with other associated problems). However, these previous studies do not draw a clear distinction between, on the one hand, the large pool of water conventionally remaining in the bottom of the pit, and, on the other hand the falling curtain of water surrounding the emergent casting. We believe this distinction to be of vital importance and have made an extensive study of the effects of simulated "run outs" of commercial purity aluminium, of various conventional aluminium alloys and of lithium containing aluminium alloys into a pool of water and, separately, into an interference relationship with a falling curtain of water.

We have found from experiments that when aluminium and conventional aluminium alloys in the molten state are allowed to "run out" into a pool of water, the molten alloy pulsates with continuous changes of surface shape and its surfaces are entirely surrounded by a differently pulsating steam blanket of continuously changing shape and thickness which insulates the molten metal from contact with the surrounding water so that heat transfer is inefficient. High speed photography shows that the metal can remain in the molten state beneath the water surface for at least 5 to 10 seconds and during this time there continues to be vigorous relative motion between water and molten metal. If, during this time of vigorous relative motion the steam blanket is disrupted, for example if a shock wave passes through the system, there is a high probability of an explosion. Such a shock wave may be of external generation; for example a heavy object being dropped into the pool or it may be a consequence of internal events such as the collapse of a steam bubble generated on a rough or dirty surface. Such a surface may be a rusty steel surface.

When molten lithium containing aluminium alloys are poured into water there is a rapid evolution of hydrogen. Hydrogen has a thermal conductivity approximately ten times greater than that of steam. The blanket around the pulsating molten lithium containing alloy is then a mixture of steam and hydrogen so that its properties of heat transfer are considerably more efficient that that of steam alone. Thus if a shock wave then passes through the system the transfer of heat from molten metal to water occurs very much more rapidly than in the case of conventional aluminium alloys and any explosion that does occur will be more violent than with such conventional alloys.

Experiments leading to the above observations were carried out using equipment permitting the safe study of molten metal/water explosions.

In a first series of experiments about 2 Kg of molten metal, in a small crucible was placed in a tipping rig over a tank made from steel but having one face made from transparent plastics containing a pool of water about 30 cm deep. The vertical fall from the tipped crucible to the water surface was about 45 cm. A detonator known by the Registered Trade Mark 'Cordtex' was attached to one of the steel sides of the tank for each test and a steel safety sheet was located over the tank between the crucible and the open tap of the tank. The whole apparatus was surrounded by substantial blast walls and was actuated from a remote bunker.

Experiments were carried out with numerous aluminium alloys and these were monitored both by video cameras and by using high speed cinematography.

The crucible was charged with molten metal at an initial temperature higher than required for the test; when its temperature which was monitored by a thermocouple had fallen to its predetermined value the steel safety sheet was removed; the crucible tilted to pour the molten metal into the water in the tank, the detonator triggered and the video and high speed cine-camera started in a predetermined sequence.

It was found that with adequate shock provided by detonation triggered at an appropriate instant, very violent explosions were produced, that wrecked the apparatus even on occasions projecting parts of it a considerable distance and severely damaging the blast walls.

In all, over 140 such experiments were carried out in the explosion trials. The variables investigated included lithium content in binary aluminium-lithium alloys, the influence of other additions such as copper and/or magnesium and/or zirconium, length of detonator, metal temperature and tank base condition. From these experiments it was established that the energy released in any explosion increased very rapidly with lithium content. While only minor differences were found in the strengths of explosions produced with various aluminium alloys containing comparable quantities of lithium, the overwhelming factors determining explosion violence were lithium content and metal temperature. It was clearly established that the explosions produced with lithium containing aluminium alloys were, as previously reported by H. M. Higgins, much more violent than those produced with conventional aluminium alloys. Beneath a certain detonator length no explosion occurred; above this length there was virtually a 100% probability of explosion. The energy released in the explosion, however, was not significantly influenced by the length of detonator employed.

These experiments established that there is a greater probability of explosion with Al/Li alloys than with other alloys of aluminium and when an explosion does occur with an Al/Li alloy it is much more violent. From the evidence of high speed cinematography it was also established that a necessary precursor for an explosion is the turbulent mixing of molten metal and water wholly beneath the surface of the water and that an explosion occurs only when a sudden disruption of the steam (steam/hydrogen in the case of Al/Li) blanket surrounding the molten metal takes place. We concluded that increasing the depth of water is an insufficient safeguard particularly in the case of Al/Li alloys where hydrogen is evolved and since we know that metal can remain liquid within the water for up to 9 to 10 seconds or more.

A further, and more extensive, series of experiments was then undertaken. In this series, quantities of molten metal in a crucible were discharged through 25 mm, 50 mm or 75 mm diameter holes to fall through a conventional water cooled DC casting mould with an aperture of 985 mm by 305 mm mounted above a casting pit approximately three meters deep. Water was supplied to the mould at a rate of about 250 liters/minute and this water flowed from the mould in the conventional way to provide a falling curtain of water which, in a normal casting operation, would impinge upon an ingot as it emerged below the mould. A baffle was located to deflect the water into the pit and produce a water pattern similar to that from a fabrication ingot during a cast. A safety tray was mounted below the crucible and moved only when all was ready. Molten metal was released from the crucible through a hole in its base upon removal of a vertical, pneumatically operated stopper. The base of the pit was of concrete gently sloped (4% gradient) from front to back and water was drawn from the lowest part of the base by scavenging pumps so that molten metal released from the crucible fell onto a very shallow moving film of water.

The results of 67 experiments are set out in Table I in which the discharge hole was 50 mm unless otherwise stated. In all cases, except where stated, the liquid metal falls 3 to 3.25 meters.

In experiments R1 to R6 commercial purity aluminium was employed. Twenty Kg of liquid metal at 720° C. was dropped on to the concrete base of the pit which had been newly coated with a bituminous compound sold under the Registered Trade Mark "TARSET". Pouring of this quantity of liquid metal through a 50 mm diameter nozzle took about 2.5 seconds. These experiments were entirely uneventful even when the "Tarset" had been burned away. In experiment R6 an expanded metal grid was placed beneath the mould to break up the liquid metal stream. No violent reaction occurred. Experiments R7 to R50 employed Al/Li alloys of varying lithium content. Experiment R51 had two moulds, one on top of the other to obtain a larger water flow rate of 450 liters/minute.

In experiments R52 and R53 a small weir at the lower part of the sloped base of the pit simulated pump failure and created a volume of water extending partially across the base. Experiment R61 had a smaller weir but here the "Cordtex" detonation was within the water restrained thereby.

In all the experiments where the molten metal contained lithium the hydrogen evolved upon mixing with water ignited noisily. However, no metal was thrown from the pit and there was no explosion. The same results were obtained when a grid was used to break up the metal stream.

Increasing the lithium content; increasing the pouring temperature; varying the discharge nozzle diameter and using different materials on the base of the pit (including aluminium plate, rusty steel, stainless steel and deliberate accumulation of debris) were all tried in the experiments. However, apart from variations in the noise and flame generated all were quite safe.

BRIEF DESCRIPTION OF THE DRAWING

The single FIGURE of the accompanying drawing shows, diagrammatically, a casting pit arrangement according to the present invention.

DESCRIPTION OF THE PREFERRED EMBODIMENT

In the drawing a concrete pit 1 of rectangular shape is provided below ground level 2. The pit has an inclined base 3 having a gradient of between 3% and 8% (about 4% is preferred) with its lower part opening into a sump 4. An inner wall 5 is spaced from a wall 6 and from the base 3 to define a space 7 generally above the sump 4. The inner wall 5 thus, effectively, becomes a wall of the pit.

A conventional water cooled mould 8 is disposed in register with the upper end 9 of the pit and is supplied with liquid metal from a launder 10 through a down pipe 11. The launder is connected with a source of liquid metal (not shown). A casting table 12 supported on a driven member 13 operated by a motor 14 is also conventional.

A manifold 15 having a plurality of outlets 16 extends across the upper part of the base 3 and the manifold and the mould 8 are supplied with water through a pipe 17. Water flows through the mould 8 in known manner and out through apertures 18 therein in streams 19 to impinge upon an ingot emerging below the mould. This water passes into the pit and a typical rate of flow might be 250 liters/minute for a single rolling ingot. Higher rates would, of course, be necessary when several ingots were cast simultaneously. Water also passes into the manifold 15 and out of the outlets 16 to flow smoothly across the base 3 and particularly into the corners of the base and along its side edges.

Three scavenging pumps 20 are mounted within the space 7 and have their inputs 21 connected with the sump 4 and their outputs 22 connected in parallel to a pipe 23 which discharges externally of the pit.

Although for purposes of illustration the pumps have been shown one above the other they are preferably mounted side by side. Each of the pumps has a capacity capable of handling the maximum quantity of water that can be delivered to the pit via the mould 8 and the manifold 15 and is capable of acting independently of the others.

A water level detector 24 is disposed at the upper part of the sump and when triggered, sets off an alarm 25.

The casting operation can be shut down manually in a very short time (of the order of 20 seconds) by diverting the flow of molten metal in the launder 10 away from the mould 8. The volume of the water drainage sump 4; the inclination of the base 3 and the capacity of each pump 20 are all chosen in relation to the maximum rate of supply of water to the pit so that during this shut down period no pool of water can build up across the bottom 3 of the pit.

During casting, water from the manifold 15 continuously sweeps across and wets the entire base 3; into its corners and along its side edges. This water does not affect the casting operation and is not a source of danger in the event of a "run-out". However, should a "run-out" occur it rapidly quenches molten metal on the base 3 to reduce the production of objectionable fumes.

It will be understood that in addition to triggering the alarm 25, the output of the detector 24 could be used, via control apparatus (not shown), to shut down the casting operation automatically.

In a modification (not shown) baffles could extend upwardly and inwardly from the walls of the pit to catch some liquid metal during any "run-out". In such case the lowermost part of the baffles would communicate with a subsidiary sump scavenged by the pumps 20.

Although the pit 1 has been described as being below ground level it could be partially or wholly above ground level. Such an arrangement would require a metal melting furnace supplying the mould 8 to be mounted in an elevated position but would enable scavenging of water to be by gravitational flow and the mechanical handling of the castings would be simplified.

Although the method and apparatus of the present invention have been developed particularly for casting Al/Li alloys they can, with advantage, be employed for other light metal alloys.

The scavenging pumps 20 can be arranged to be pneumatically actuated as well as electrically driven, being supplied for example with bottled nitrogen, so that they can still be operated in an emergency resulting from a failure in the electricity supply. Alternatively, separate pneumatically driven scavenging pumps can be provided for the same purpose.

A casting assembly has now been in regular experimental use casting a variety of experimental aluminium-lithium based alloys by the present method. While the test results discussed above all related to experiments in which fault situations were deliberately simulated, a significant number of "run-outs" has been experienced during this regular use of the assembly.

Indeed, using ingots with typical dimensions of 985 mm×305 mm×1500 mm, in a recorded ninety-six casting attempts, there were forty-four "run-outs" experienced, producing as much as 70 Kg of "run-out" metal each time but no occurrence dangerous to either operators or equipment was observed.

TABLE 1

| Test No | Composition (wt %) Li | Cu | Mg | Metal Weight (kg) | Release Temperature (°C.) | Water flow liters/min | Conditions |
|---|---|---|---|---|---|---|---|
| R1 | 0 (99.5% Al) | | | 20 | 735 | 250 | Test run into dry catchment trough |
| R2 | | " | | 20 | 700 | 250 | Drop on to freshly "Tarset" coated base |
| R3 | | " | | 20 | 695 | 250 | Drop on to freshly "Tarset" coated base |
| R4 | | " | | 20 | 680 | 250 | Drop on to same position on base (ie where "Tarset" had burned off) |
| R5 | | " | | 20 | 700 | 250 | Drop on to same position on base (ie where "Tarset" had burned off) |
| R6 | | " | | 20 | 710 | 250 | Drop through expanded metal grid 50 cm below mould |
| R7 | 2.18 | 1.22 | 0.67 | 20 | 700 | 250 | Drop on to freshly "Tarset" coated base |
| R8 | 2.06 | 1.28 | 0.65 | 20 | 700 | 250 | Repeat of 7 |
| R9 | 2.06 | 1.25 | 0.63 | 20 | 700 | 250 | Dropped through expanded metal grid 75 cm below mould |
| R10 | 2.32 | | | 20 | 700 | 250 | Repeat of 9 |
| R11 | 2.31 | | | 20 | 700 | 250 | Repeat of 10 |
| R12 | 2.27 | | | 20 | 700 | 250 | Repeat of 11 |
| R13 | 3.06 | | | 20 | 700 | 250 | No grid. Poured on to base. Higher Li. |
| R14 | 2.20 | | | 20 | 700 | 250 | Dropped through inclined grid 75 cm below mould |
| R15 | 3.30 | | | 20 | 700 | 250 | As 14 but debris not removed before next test |
| R16 | 3.06 | | | 20 | 700 | 250 | Grid at 30° debris on base |
| R17 | 2.77 | | | 20 | 700 | 250 | No grid. Evenly spread debris on base. |
| R18 | 3.02 | | | 20 | 700 | 250 | Clean base. Direct pour. |
| R19 | 3.12 | | | 20 | 750 | 250 | Clean base. Direct pour. |
| R20 | 4.30 | | | 20 | 750 | 250 | Very high Li. Direct pour. |
| R21 | 2.33 | | | 20 | 700 | 250 | Poured on to Al plate on base |
| R22 | 2.83 | | | 20 | 750 | 250 | Poured on to old concrete base |
| R23 | 2.96 | | | 20 | 750 | 250 | As 22 (higher temperature had been intended) |
| R24 | 2.56 | | | 20 | 780 | 250 | On to old concrete base |

TABLE 1-continued

| Test No | Composition (wt %) Li | Cu | Mg | Metal Weight (kg) | Release Temperature (°C.) | Water flow liters/min | Conditions |
|---|---|---|---|---|---|---|---|
| R25 | 3.14 | | | 20 | 775 | 250 | Through metal grid on to old base |
| R26 | 4.12 | | | 30 | | 250 | Bad leak - aborted |
| R27 | 2.46 | | | 20 | 700 | 250 | Stainless steel base |
| R28 | 3.13 | | | 20 | 750 | 250 | Stainless steel base |
| R29 | 2.92 | | | 20 | 770 | 250 | Stainless steel base |
| R30 | 4.00 | | | 20 | 700 | 250 | Poured on to rusty steel base |
| R31 | 4.14 | | | 20 | 750 | 250 | Poured on to rusty steel base |
| R32 | 2.77 | | | 20 | 700 | 250 | Concrete base: poured with 75 mm diameter hole |
| R33 | 3.45 | | | 20 | 725 | 250 | Concrete base: poured with 75 mm diameter hole |
| R34 | 3.49 | | | 20 | 750 | 250 | Concrete base: poured with 75 mm diameter hole |
| R35 | 2.82 | | | 20 | 725 | 250 | Straight down 75 mm diameter hole |
| R36 | 3.06 | | | 20 | 725 | 250 | Straight down 75 mm diameter hole |
| R37 | 2.80 | | | 20 | 680 | 250 | Straight down 75 mm diameter hole |
| R38 | 3.07 | | | 20 | 680 | 250 | Through grid 75 cm below crucible 75 mm diameter hole |
| R39 | 3.06 | | | 30 | 700 | 250 | Straight down 75 mm diameter nozzle |
| R40 | 2.54 | | | 18 | 700 | 250 | Rusty steel base: 75 mm diameter nozzle |
| R41 | | | | 20 | 700 | 250 | Straight down onto "Tarset" |
| R42 | | | | 20 | 700 | 250 | coated base. 50 mm dia nozzle |
| R43 | 2.46 | | | 20 | 700 | 250 | 37 mm wier on base. |
| R44 | 2.81 | | | 20 | 750 | 250 | 37 mm wier on base. |
| R45 | 3.57 | | | 20 | 700 | 125 | Plain base. Straight down |
| R46 | 4.09 | | | 20 | 700 | nil | Straight down. Water turned off 20 seconds before pour. |
| R47 | 2.48 | | | 20 | 700 | 250 | Outer stainless base raised 17 mm. |
| R48 | 3.01 | | | 20 | 700 | 250 | Poured near to tank walls |
| R49 | 3.72 | | | 20 | 700 | 250 | Repeat of 48 |
| R50 | 3.67 | | | 20 | 700 | 250 | 37 mm wier. 50 mm debris over base |
| R51 | 2.21 | | | 20 | 700 | 450 | 2 moulds full of water |
| R52 | 3.00 | | | 20 | 700 | 450 | 75 mm weir on base |
| R53 | 2.60 | | | 20 | 760 | 450 | 75 mm weir |
| R54 | 3.33 | | | 30 | 700 | 450 | 25 mm diameter nozzle |
| R55 | 3.11 | | | 10 | 700 | 250 | 25 mm diameter nozzle |
| R56 | 2.40 | | | 20 | 700 | 250 | 25 mm diameter nozzle. Base plate raised (ie shorter metal fall) |
| R57 | 3.20 | | | 20 | 700 | 250 | Attempt with Cordtex but did not detonate |
| R58 | 3.23 | | | 20 | 700 | 250 | Cordtex on plate beside metal stream |
| R59 | 3.06 | | | 20 | 700 | 250 | On to stainless steel, Cordtex under plate |
| R60 | 2.83 | | | 40 | 700 | 250 | 75 mm diameter nozzle |
| R61 | 3.23 | | | | 700 | 250 | 37 mm weir: Cordtex detonation |
| R62 | 2.80 | | | 40 | 750 | 250 | Cordtex under stainless steel |
| R63 | 2.92 | | | 40. | 750 | 250 | Straight down |
| R64 | 3.92 | | | 20 | 715 | 250 | 11.2 kg bar falling 1.58 meters to give shock wave |
| R65 | 3.18 | | | 20 | 720 | 250 | Repeat of 64 |
| R66 | 2.88 | | | 20 | 705 | 250 | 3.7 kg bar falling 1.5 meters |
| R67 | 3.30 | | | 20 | 700 | 250 | 11.2 kg bar falling 0.58 meters Release failed. |

In Tests nos R10 to R67 the composition of the alloy included the base material plus 1.2% Cu and 0.65% Mg.

We claim:

1. A method of vertical, semi-continuous direct chill casting of light metal fabricating ingots through an open mould into a pit, comprising commencing the casting without a pool of water within the pit, supplying cooling water to the emergent ingot at a predetermined rate and continuously removing water from the pit as casting continues at a rate sufficient to ensure that no build up of a pool of water in the pit occurs.

2. A method according to claim 1 comprising continuously supplying water across the base of the pit.

3. A method according to claim 1 comprising detecting any build up of water in the pit and thereupon shutting down the casting operation in a time less than that taken for a pool of water to extend across the entire pit.

4. A method according to claim 2 comprising detecting any build up of water in the pit and thereupon shutting down the casting operation in a time less than that taken for a pool of water to extend across the entire pit.

5. Apparatus for the vertical semi-continuous direct chill casting of light metal fabrication ingots through an open mould disposed above a pit for receiving the resultant casting including means for supplying cooling water to the mould, to the surface of the emergent ingot and into the pit, comprising means, communicating with every part of the pit at which a pool of water could build up, capable of continuously removing water from all such parts at a total rate greater than the maximum rate of supply of water to all such parts of the pit; and water level detector means the output from which is operable to shut down the casting operation.

6. Apparatus for the vertical semi-continuous direct chill casting of light metal of fabrication ingots through an open mold disposed above a pit for receiving the resulting casting including means for supplying cooling water to the mold, to the surface of the emerging ingot and into the pit, comprising means, communicating with every part of the pit at which a pool of water could build up, capable of continuously removing water from all such parts at a total rate greater than the maximum rate of supply of water to all such parts of the pit, and in which the base of the pit is inclined to the horizontal.

7. Apparatus according to claim 6 in which a plurality of pumps arranged in parallel discharge water from the sump; each of the pumps having a capacity greater than the maximum rate of supply of water to the pit and being capable of acting independently of the others.

8. Apparatus according to claim 7 in which each said pump or additional such pumps are pneumatically-operated, so as to be operable in the event of a failure in electricity supply.

9. Apparatus according to claim 6 in which the inclination of the base of the pit is at a gradient of 3% to 8%.

10. Apparatus according to claim 6 in which the lowermost part of the base communicates with a sump.

11. Apparatus according to claim 6 comprising a water dispensing manifold disposed at the uppermost part of the base.

* * * * *